US010240280B2

(12) United States Patent
Lim et al.

(10) Patent No.: US 10,240,280 B2
(45) Date of Patent: Mar. 26, 2019

(54) STEAM GENERATOR FOR A STEAMING DEVICE

(71) Applicant: KONINKLIJKE PHILIPS N.V., Eindhoven (NL)

(72) Inventors: Gary Chi Yang Lim, Eindhoven (NL); Chee Keong Ong, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 46 days.

(21) Appl. No.: 15/504,687

(22) PCT Filed: Jul. 3, 2015

(86) PCT No.: PCT/EP2015/065201
§ 371 (c)(1),
(2) Date: Feb. 17, 2017

(87) PCT Pub. No.: WO2016/030061
PCT Pub. Date: Mar. 3, 2016

(65) Prior Publication Data

US 2017/0268161 A1 Sep. 21, 2017

(30) Foreign Application Priority Data

Aug. 26, 2014 (EP) ..... 14182182

(51) Int. Cl.
*D06F 75/12* (2006.01)
*D06F 39/06* (2006.01)
(Continued)

(52) U.S. Cl.
CPC ..... *D06F 75/12* (2013.01); *D06F 39/008* (2013.01); *D06F 39/06* (2013.01); *F22B 1/284* (2013.01)

(58) Field of Classification Search
CPC ..... D06F 75/10; D06F 75/12; D06F 75/14; D06F 75/16; D06F 39/08; D06F 39/06;
(Continued)

(56) References Cited

U.S. PATENT DOCUMENTS 2,189,709 A 2/1940 Deems
2,199,911 A * 5/1940 Edwards ..... D06F 75/16 38/77.82
2,456,490 A 12/1948 Busch
2,769,258 A * 11/1956 Hoecker ..... D06F 75/16 38/77.82
2,803,073 A * 8/1957 Raihle ..... D06F 75/16 38/77.82
(Continued)

FOREIGN PATENT DOCUMENTS

DE 69411521 T2 1/1999
DE 10224562 A1 * 8/2003
(Continued)

*Primary Examiner* — Ismael Izaguirre

(57) ABSTRACT

The present application relates to a steam generator (40) for a steaming device (10) comprising a chamber (42) having a base (46) and a liquid receiving space (47) above the base (46), a heater (50) for heating water in the liquid receiving space (47), a steam outlet (49), and a foaming restriction barrier (70) disposed between the steam outlet (49) and the base (46). The foaming restriction barrier (70) comprises a first barrier section (71) spaced from the liquid receiving space (47) between the steam outlet (49) and the liquid receiving space (47). The first barrier section (71) is configured to prevent foam from passing into the steam outlet (49). The foaming restriction barrier (70) also comprises a second barrier section (72) spaced from the first barrier section (71) between the first barrier section (71) and the liquid receiving space (47). The second barrier section (72) is configured to prevent foam from passing from the liquid receiving space (47) into an intermediate space (85) between the first and second barrier sections (71, 72). The second
(Continued)

barrier section (72) is configured so that all the steam generated from heating water in the liquid receiving space (47) below the second barrier section (72) passes through the second barrier section (72) into the intermediate space (85) and, from the intermediate space (85) through the first barrier section (71), before passing through the steam outlet (49).

18 Claims, 2 Drawing Sheets

(51) Int. Cl.
*D06F 39/00* (2006.01)
*F22B 1/28* (2006.01)

(58) Field of Classification Search
CPC ..... D06F 39/008; F22B 33/18; F22B 33/185; F22B 1/00; F22B 1/28; F22B 1/284
See application file for complete search history.

(56) References Cited

U.S. PATENT DOCUMENTS

| | | | | |
|---|---|---|---|---|
| 3,745,306 | A * | 7/1973 | Naritomi | A45D 7/00 34/97 |
| 8,109,119 | B2 | 2/2012 | Ahn | |
| 2010/0018085 | A1 * | 1/2010 | Jiang | D06F 75/12 38/77.9 |
| 2010/0229434 | A1 * | 9/2010 | Chadha | D06F 75/12 38/77.8 |
| 2016/0201255 | A1 * | 7/2016 | Chua | D06F 75/10 38/77.8 |

FOREIGN PATENT DOCUMENTS

| | | | |
|---|---|---|---|
| DE | 102004032361 | A1 | 8/2005 |
| WO | WO 03062518 | A1 * | 7/2003 |
| WO | 2006126778 | A1 | 11/2006 |

* cited by examiner

STEAM GENERATOR FOR A STEAMING DEVICE

This application is the U.S. National Phase application under 35 U.S.C. § 371 of International Application No. PCT/EP2015/065201, filed on Jul. 3, 2015, which claims the benefit of International Application No. 14182182.7 filed on Aug. 26, 2014. These applications are hereby incorporated by reference herein.

FIELD OF THE INVENTION

The present invention relates to a steam generator for a steaming device, in particular a steam generator with a foaming restriction barrier. The present invention also relates to a steaming device comprising a steam generator according to the invention.

BACKGROUND OF THE INVENTION

Steam generators are known for evaporating water into steam. Such steam generators are used in steaming devices, such as steam system irons, to produce steam. The steam may then be used to provide a treatment, for example, application to fabric of garments to remove creases.

Pressurised steam generators generally comprise a boiler comprising a chamber for receiving water and a heater for heating the water in the chamber and converting it into steam. Water is fed into the chamber via a water inlet, and steam exits the chamber via a steam outlet. Water fed into the chamber generally contains some impurities. During use of the steam generator, contaminants are left behind in the chamber as the water is evaporated and flows from the chamber. The accumulation of these contaminants over time promotes a phenomenon known as foaming. Foaming involves water bubbles being created due to the presence of the contaminants. The creation of these water bubbles in the chamber is known to cause water to flow through out through the steam outlet together with steam. This causes water droplets to be deposited on the fabric.

It is also known to use a water level sensor to determine the volume of water in the chamber, and therefore control the supply of water to the chamber. However, foaming may cause a false positive to be detected by the water level sensor, for example by water bubbles coming into contact with the water level sensor. This may cause the volume of water to fall to an undesirable level.

SUMMARY OF THE INVENTION

It is an object of the invention to provide a steam generator and/or a steaming device which alleviates or substantially overcomes the problems mentioned above.

The invention is defined by the independent claims; the dependent claims define advantageous embodiments.

According to the invention, there is provided a steam generator for a steaming device comprising a chamber having a base and a liquid receiving space above the base, a heater for heating water in the liquid receiving space, a steam outlet, and a foaming restriction barrier disposed between the steam outlet and the base that comprises a first barrier section spaced from the liquid receiving space between the steam outlet and the liquid receiving space, the first barrier section being configured to prevent foam from passing into the steam outlet, and a second barrier section spaced from the first barrier section between the first barrier section and the liquid receiving space, the second barrier section being configured to prevent foam from passing into an intermediate space between the first and second barrier sections. The second barrier section is configured so that all the steam generated from heating water in the liquid receiving space below the second barrier section passes through the second barrier section into the intermediate space and, from the intermediate space through the first barrier section, before passing through the steam outlet.

The first barrier section may cover the steam outlet. Therefore, it is possible to easily provide shielding to the steam outlet from foam generated during operation of the steam generator.

The first barrier section may be substantially L-shaped. Therefore, the first barrier section is simply arranged. The size of the first barrier section may therefore be minimised.

The steam outlet may be disposed in a corner of the chamber. The first barrier section may cover the corner of the chamber. Therefore, the steam outlet may be simply protected.

With this arrangement, it is possible to maximise the effectiveness of the foaming restriction barrier. This arrangement helps to ensure that any foaming that is received in an intermediate space between the first and second barrier sections is unable to pass to the steam outlet due to the positioning of the first barrier section. This helps to provide double redundancy in the foaming restriction barrier.

The effectiveness of the first barrier section is maximised, and the volume of foaming that may contact the first barrier section is minimised. The second barrier section may cover the liquid receiving space.

This means that the second barrier section is able to extend across the extent of the chamber. Therefore, the second barrier section is able to maximise the shielding provided to the intermediate space.

The second barrier section may comprise a recessed portion defining a recess which extends into the liquid receiving space.

With this arrangement it is possible to dispose a component, such as a sensor, in the liquid receiving space whilst providing at least some protection from the sensor coming into contact with foaming.

The recessed portion may have an elongated dome shape.

With this arrangement the volume of recess in the liquid receiving space may be minimised. Therefore, scale in the recess is able to accumulate at a lower end of the recess.

The steam generator may further comprise a water sensor to detect water in the liquid receiving space, wherein the water sensor may be in the recess.

With this arrangement it is possible to dispose the water sensor in the liquid receiving space whilst providing at least some protection from the sensor coming into contact with foaming due to the second barrier section extending at least partially around the recess.

The second barrier section may comprise a planar portion.

With this arrangement, the flow of steam through the foaming restriction barrier may be maximised.

The steam generator may further comprise a water inlet passing through the second barrier section and reaching the liquid receiving space.

With this arrangement, water is restricted from flowing along or through the foaming restriction barrier. Therefore, the efficiency of the foaming restriction barrier is maximised.

The foaming restriction barrier may comprise a mesh panel. Optionally, the mesh panel may be a perforated sheet. The mesh panel may have select perforated areas.

With this arrangement the foaming restriction barrier may be simply formed. The reliability of the foaming restriction barrier is maximised due to the absence of any moving parts.

According to another aspect of the present invention, there is provided a steaming device comprising a steam generator as described above.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1:
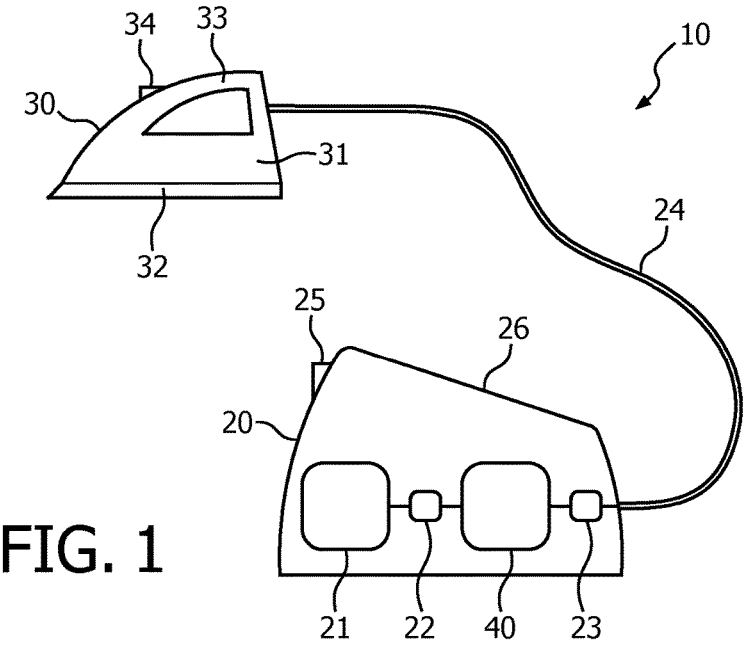
FIG. 1 is a schematic view of a steam system iron with a steam generator according to the present invention.

A steam system iron 10, acting as a steaming device, is shown in FIG. 1 comprising a base unit 20 and a steaming head 30. The steam system iron 10 is configured to generate steam to be emitted against a fabric to be treated. Although the invention will be described herein by reference to a steam system iron, it will be understood that alternative arrangements are envisaged. For example, the steaming device may be a handheld steam iron, a garment steamer or a wallpaper steamer.

The base unit 20 has a steam generator 40. A water reservoir 21 in the base unit 20 holds water to be converted into steam. A pump 22 is provided to supply water from the water reservoir 21 to the steam generator 40. A valve 23 is provided to control the flow of steam from the steam generator 40. The base unit 20 fluidly communicates with the steaming head 30 via a hose 24. The hose 24 is configured to allow the flow of steam from the base unit 20 to the steaming head 30. The hose 24 communicates with the steam generator 40 via the valve 23. The hose 24 includes a tube (not shown) forming a path along which steam is able to flow. The hose 24 may also include, for example, at least one communication cable (not shown) along which electrical power and/or control signals may be sent between the base unit 20 and the steaming head 30. The base unit 20 also includes a power supply unit (not shown) for supplying power to components of the steam system iron 10. A user input 25 is on the base unit 20 for controlling operation of the steam system iron 10. The base unit 20 also has a stand 26 for receiving the steaming head 30. A controller (not shown) is configured to control operation of the steam system iron 10.

The steaming head 30 has a body 31 and a soleplate 32. The body 31 further comprises a handle 33. The handle 33 enables a user to hold and manoeuvre the steaming head 30. A user input 34 is on the body 31 for operating the steam system iron 10. Steam is provided to the steaming head 30 via the hose 24. The steaming head 30 has steam vents (not shown) in the soleplate 32 through which steam flows from the steaming head 30 to be provided to a fabric, for example.

Figure 2:
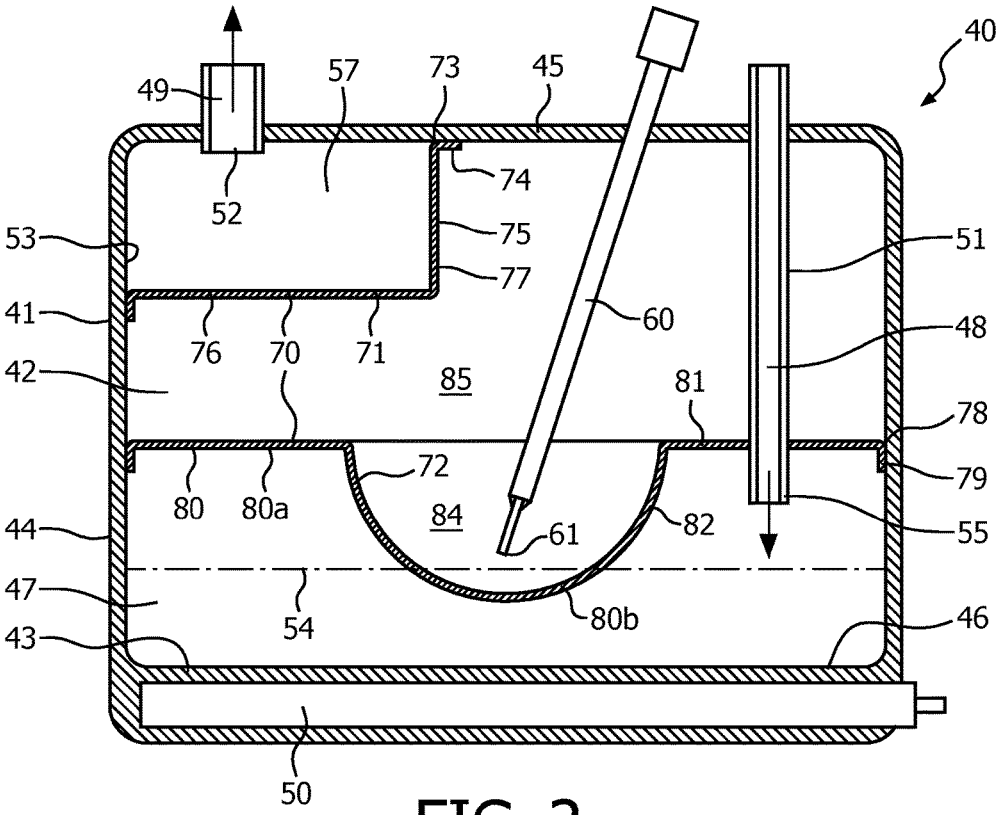
FIG. 2 is a cut-away diagrammatic view of the steam generator of FIG. 1 according to the present invention.

Referring now to FIG. 2, one embodiment of the steam generator 40 is shown in partial cross-section. Although the steam generator 40 as described herein is for use in a steam system iron, it will be understood that use of the steam generator 40 is not limited thereto, and may, for example, be used with alternative steam generator systems.

The steam generator 40 comprises a housing 41 and a chamber 42. The chamber 42 is defined by the housing 41. The housing 41 is generally cylindrical, although it will be understood that alternative arrangements are possible. The housing 41 has a base wall 43, a side wall 44 and an upper wall 45. The chamber 42 has a base 46. The base 46 is defined by the housing base wall 43. The housing 41 defines a chamber surface 53.

A heater 50 is in the base wall 43. The heater 50 is integrally formed in the base wall 43. The heater 50 is configured to heat water received in the chamber 42 to convert the water into steam. The chamber 42 and heater 50 act as a boiler. The heater 50 is operated by the controller (not shown) and provided with power by the power supply unit (not shown). Alternative heater arrangements are envisaged. For example, at least part of the heater 50 may be received in the chamber 42. Alternatively, the heater 50 may be disposed beneath the base wall 43, or may provide heat to the chamber 42 via the side wall 44, for example. In the present arrangement an electrical heater is used, although alternative heaters may be used.

The chamber 42 is configured to hold water. A liquid receiving space 47 is defined in the chamber 42. The liquid receiving space 47 is defined in a lower section of the chamber 42. The liquid receiving space 47 extends from the base 46. It will be understood that the chamber 42 should not be normally completely filled with water during operation of the steam generator 40 to maximise steam generation. Therefore, a section of the chamber 42 is defined to generally receive water, in this case defined the liquid receiving space 47, and the remainder of the chamber 42 is generally for receiving air and steam.

The chamber 42 is generally cylindrical, although it will be understood that alternative arrangements are possible. The base 46 defines the lower end of the chamber 42. A water inlet 48 is provided to supply water into the chamber 42. The water inlet 48 passes through the second barrier section 72 and reaches the liquid receiving space 47. A steam outlet 49 is provided through which steam is able to flow from the chamber 42.

The water inlet 48 comprises a pipe 51. In the present arrangement, the pipe 51 extends in the chamber 42. The pipe 51 is elongate. The pipe 51 extends from the upper end of the chamber 42. That is, in the present embodiment the pipe 51 extends into the chamber 42 from the upper wall 45. The pipe 51 communicates with the water reservoir 21 (refer to FIG. 1) via the pump 22. The water reservoir 21 and pump 22 act as a water supply. Alternative water supply arrangements are possible. An open end 55 of the pipe 51, through which water flows into the chamber 42, extends in the chamber 42 to the liquid receiving space 47. In another arrangement, the open end 55 of the pipe 51 extends proximate to the liquid receiving space 47. In an alternative arrangement, the pipe 51 does not extend into the chamber 42. In such an arrangement, the water inlet 48 comprises an opening (not shown) in the housing 41 communicating directly with, or proximate to, the liquid receiving space 47.

The steam outlet 49 comprises an outlet aperture 52. The steam outlet 49 communicates with the chamber 42 at the upper end of the chamber 42. In the present embodiment, the steam outlet 49 is in the upper wall 45. The steam outlet 49 is distal to the liquid receiving space 47. Steam generated in the chamber 42 is able to flow through the steam outlet 49 to exit the chamber 42.

A water probe 60 is received in the chamber 42. The water probe 60 acts as a water level sensor. That is, the water probe 60 is configured to determine the presence of water in the liquid receiving space 47. The water probe 60 is configured to determine the presence of water at a sensing end 61 of the water probe 60. The water probe 60 is elongate. The sensing end 61 of the water probe 60 is in the chamber 42. The sensing end 61 is disposed between an upper plane 54 of the liquid receiving space 47 and the base 46. The upper plane 54 is a maximum height in the chamber 42 to which the liquid receiving space 47 extends. The sensing end 61 is received substantially equidistant from the peripheral side wall 44 to help allow for any tilting of the steam generator 40.

The steam generator 40 further comprises a foaming restriction barrier 70. The foaming restriction barrier 70 is liquid permeable. The foaming restriction barrier 70 is in the chamber 42. The foaming restriction barrier 70 comprises a first barrier section 71 and a second barrier section 72. The first barrier section 71 is spaced from the second barrier section 72.

The first barrier section 71 of the foaming restriction barrier 70 is received in the chamber 42. The first barrier section 71 is liquid permeable. The first barrier section 71 is spaced from the liquid receiving space 47. The first barrier section 71 covers the steam outlet 49. That is, the first barrier section 71 acts to shield the steam outlet 49. The periphery of the first barrier section 71 extends from the chamber surface 53. Therefore, there are no gaps between an edge 73 of the first barrier section 71 and the chamber surface 53. A mounting flange 74 extends along the edge 73 of the first barrier section 71 to mount the first barrier section 71 to the housing 41. In the present arrangement the mounting flange 74 is welded to the housing 41 to enable simple assembly of the steam generator 40.

The first barrier section 71 defines an outlet space 57 which is separated from the remainder of the chamber 42 by the first barrier section 71. The first barrier section 71 is for example formed by a perforated sheet. The perforated sheet acts as a mesh material. That is, a sheet having a plurality of spaced, generally uniform, small openings 75 formed through the thickness of the sheet. In the present arrangement the openings 75 are circular, however alternative shapes are possible. The diameter of each opening 75 is between about 1 to 5 mm. The thickness of the perforated sheet is 0.3 mm or greater. This helps provide the perforated sheet with sufficient structural strength to hold itself in place.

Preferably, the steam outlet 49 is disposed in a corner of the chamber 42, and the first barrier section 71 covers said corner.

The first barrier section 71 is preferably substantially L-shaped. A lower portion 76 extends from the side wall 44, substantially parallel to the base 46. An upper portion 77 extends perpendicularly from the lower portion 76 to the upper wall 45. However, it will be understood that the configuration of the first barrier section 71 may vary. For example, the first barrier section 71 may be planar, and extend parallel to the base 46.

The second barrier section 72 of the foaming restriction barrier 70 is received in the chamber 42. The second barrier section 72 is liquid permeable. The second barrier section 72 is disposed between the base 46 and the first barrier section 71. The first barrier section 71 is disposed between the second barrier section 72 and the steam outlet 49. The second barrier section 72 extends across the chamber 42. The second barrier section 72 acts to shield the steam outlet 49. The periphery of the second barrier section 72 extends from the chamber surface 53. Therefore, there are no gaps between a second barrier edge 78 of the second barrier section 72 and the chamber surface 53. A second barrier mounting flange 79 extends along the second barrier edge 78 of the second barrier section 72 to mount the second barrier section 72 to the housing 41. In the present arrangement the second barrier mounting flange 79 is welded to the housing 41 to enable simple assembly of the steam generator 40. The second barrier section 72 is spaced from the base 46.

The second barrier section 72 comprises a planar portion 81 and a recessed portion 82. The planar portion 81 extends around the recessed portion 82. The planar portion 81 extends from the side wall 44. The planar portion 81 is spaced from the liquid receiving space 47. The recessed portion 82 protrudes from the planar portion 81. The recessed portion 82 extends downwardly towards the base 46. The recessed portion 82 in the present embodiment is a dome shape. However, the recessed portion 82 in another embodiment is an inverted elongated dome shape. That is, a dome shape with a cylindrical section. The recessed portion 82 is spaced from the side wall 44. The recessed portion 82 defines a recess 84. The recess 84 forms part of an intermediate space 85 defined in the chamber 42 between the first and second barrier sections 71, 72.

The recessed portion 82, in the present arrangement, extends into the liquid receiving space 47. That is, the recessed portion 82 extends below the upper plane 54 of the liquid receiving space 47. Therefore, at least part of the recess 84 is defined in the liquid receiving space 47. When water is received in the liquid receiving space 47, it will be understood that water may come into contact with the recessed portion 82 of the second barrier section 72. Therefore, water is receivable in the recess 84 defined by the recessed portion 82.

The water probe 60 is received in the recess 84 defined by the recessed portion 82. The sensing end 61, acting as the sensing element of the water probe 60, is in the recess 84. The sensing end 61 is disposed below the upper plane 54 of the liquid receiving space 47. The water probe 60 is configured to determine when the water height in the chamber 42 is at or below a minimum desired volume. The water probe 60 is in the intermediate space 85. This helps to prevent false positive detection of water caused to foaming by the second barrier section 72 acting to restrict foaming.

It will be understood that water is receivable in the intermediate space 85 of the chamber 42, above the second barrier section 72, during normal operation of the steam generator 40. In the present arrangement, the area of the recessed portion 82 is smaller than the planar portion 81 to minimise the volume of water in the intermediate space 85.

The second barrier section 72 is formed by a perforated sheet. The perforated sheet acts as a mesh material. That is, a sheet having a plurality of spaced, generally uniform, small openings 80 formed through the thickness of the sheet. In the present embodiment the openings 80 are circular, however alternative shapes are possible. In the present embodiment, the configuration of the openings 80*a* in the planar portion 81 differs from the configuration of the openings 80*b* in the recessed portion 82. With this embodiment the diameter of the openings 80*b* in the recessed portion 82 are greater than the diameter of the openings 80*a* in the planar portion 81. This helps allow water to flow through the recessed portion 82 into the recess 84, but restricts water passing through the planar portion 81. The diameter of each opening 80*b* in the planar portion 81 is between about 1 to 5 mm. The diameter of each opening 80*b* in the recessed portion 82 is between about 1 to 5 mm. The thickness of the perforated sheet is 0.3 mm or greater.

It will be understood that the configuration of the second barrier section 72 may vary. For example, the recessed portion 82 may have an alternative shape, for example cylindrical. In an alternative arrangement, the recessed portion 82 may be at the periphery of the planar portion 81. That, is the recessed portion 82 may extend from the side wall 44. The position of the recessed portion 82 is dependent on the position of the sensing end 61 of the water probe 60. It will be understood that the recessed portion 82 may extend to the base 46.

The open end 55 of the pipe 51, through which water flows into the chamber 42, extends in the chamber 42 to the liquid receiving space 47. The pipe 51 extends through a pipe opening 56 in the second barrier section 72. The pipe opening 56 corresponds to the diameter of the pipe 51.

During use of the steam generator 40, water is initially supplied into the chamber 42 via the water inlet 48. The water inlet 48 opens directly into the liquid receiving space 47, and so water does not flow through the planar portion 81 of the second barrier section 72. As water flows into the chamber 42, the water height above the base 46 increases. Water then contacts the recessed portion 82 of the second barrier section 72 as the recessed portion 82 extends into the liquid receiving space 47. Water passes through the recessed portion 82 and so water extends in the recess 84. With this arrangement a minimal volume of water is present in the intermediate space 85 whilst providing for the water probe 60 being disposed in the intermediate space 85. When water does not contact the sensing end 61 of the water probe 60, it is determined that the water height in the chamber 42 is below a minimum level, and a flow of water into the chamber 42 is provided, for example through use of a valve (not shown). When it is determined that the water level is at or above the minimum level as determined by the water probe 60, the flow of water into the chamber 42 is stopped. It will be understood that as the water is heated and converted into steam that the water level will drop. When this occurs, the flow of water into the chamber 42 is restarted. The water flow rate may be controlled through operation of the valve (not shown) by a controller (not shown).

The heater 50 is operated to heat the water in the chamber 42. In the present embodiment, the heater 50 is in the base wall 43 of the housing 41 and so heat is conducted through the housing to the water in the chamber 42. The chamber surface 53 acts as a heating surface. As the water is heated the water is evaporated into steam. The steam is able to flow through the second barrier section 72 into the intermediate space 85. The steam then flows through the first barrier section 71 to the outlet space 57 and out of the chamber 42 through the steam outlet 49.

During continued use of the steam generator 40, contaminants may build up in the liquid receiving space 47. The water and contaminants may together cause foaming on the surface of the water when the steam generator 40 is operated. This foaming creates bubbles which extend above the water level in the liquid receiving space 47. Without constraints, this foaming may extend to the steam outlet 49 such that foam passes through the steam outlet 49. However, in the present embodiments the foaming restriction barrier acts to restrict foaming, and prevent effects caused by foaming, such as spitting, excess water flowing from the steam outlet 49, and the passage of contaminants in water passing from the steam outlet 49. As foaming is generated due to the heating of water and contaminants, the foam comes into contact with the first barrier section 71. This causes the bubbles to burst and limits the extent to which the foam is able to extend in the chamber 42. Due to the perforations formed in the sheet steam is able to pass through the first barrier section 71 into the intermediate space 85.

Steam and any foam in the intermediate space 85 then flows towards the second barrier section 72 into the outlet space 57. This steam and foam contacts the second barrier section 72. The second barrier section 72 acts to prevent the foam from flowing therethrough, however the steam is able to flow into the outlet space 57 and then pass through the steam outlet 49. Therefore, the foaming restriction barrier 70 prevents the build-up of foam in the steam generator 40, and acts to stop foam and the effects of the foam such as excess water passing through the steam outlet 49.

With the present arrangement, the recessed portion 82 of the second barrier section 72 extends into the liquid receiving space 47 such that the water probe 60 is able to determine the level of water in the chamber 42. As the second barrier section 72 acts to separate the majority of water in the chamber 42 from the recess 84, and therefore the water probe 60 in the recess 84, the water probe 60 is restricted from coming into contact with foaming in the chamber 42 and so providing a false positive indication of the water level in the chamber 42. Although a small volume of water is received in the recess 84, and therefore the intermediate space 85, due to the arrangement of the recessed portion 82, the amount of foaming that is possible is minimised due to the volume of water in the intermediate space 85 being minimised. Furthermore, any foaming that occurs in the intermediate space 85 is prevented from passing to the steam outlet 49 by the first barrier section 71.

Figure 3:
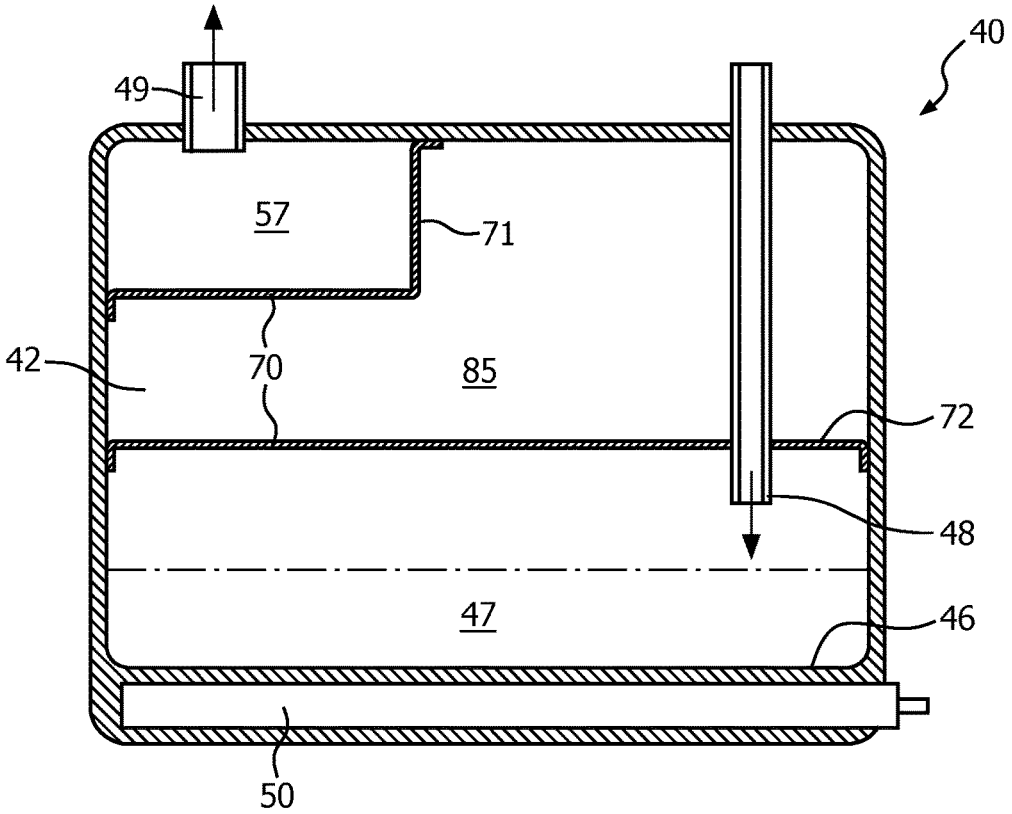
FIG. 3 is a cut-away diagrammatic view of another embodiment of the steam generator of FIG. 1 according to the present invention.

In the above described embodiments the second barrier section 72 comprises the recessed portion 82 to accommodate the water probe 60. It will be understood that the recessed portion 82 may be omitted. For example, an alternative arrangement of the steam generator 40 is shown in FIG. 3 in which the recessed portion 82 is omitted. Such an embodiment is generally the same as the embodiments described above and so a detailed description will be omitted. In such an arrangement the water probe 60 is omitted, and the volume of water in the chamber 42 controlled by an alterative arrangement. Alternatively, the water probe (not shown in FIG. 3) is retained, but the sensing end is disposed between the second barrier section 72 and the base 46. Although the foaming restriction barrier 70 will then not provide protection against foaming contacting the sensing end of the water probe (not shown in FIG. 3), it will still provide protection for the steam outlet 49. Furthermore, protection for the steam outlet 49 against foaming may be enhanced by spacing the entire second barrier section 72 from the liquid receiving space 47. Therefore, water is not received above the second barrier section 72; that is the intermediate space 85 between the second barrier section 72 and the first barrier section 71. The water inlet 48 is also exposed to the liquid receiving space 47 such that water is not fed into the intermediate space 85.

In the embodiment shown in FIG. 3, the second barrier section 72 is planar. The plane of the second barrier section 72 is substantially parallel to the base 46. The second barrier section 72 is spaced from the first barrier section 71. The second barrier section 72 is spaced from the liquid receiving space 47. Furthermore, the outlet space 57 spaces the first barrier section 71 from the steam outlet 49. With such an arrangement water is not received in the intermediate space 85. Therefore, no water is received at or above the first barrier section 71. This helps to maximise the efficiency of the foaming restriction barrier 70 by providing that all foam generated by water in the chamber 42 must pass through both the first and second barrier sections 71, 72 before it could reach the steam outlet 49.

Preferably, the steam generator 40 according to the invention comprises a rinse outlet (not shown) located below the foaming restriction barrier 70. For example, the rinse outlet is arranged on the side wall 44. The rinse outlet is for example equipped with a screw opening mechanism to access the inside of the steam generator 40, for example for cleaning purpose.

Although in the above described embodiments the foaming restriction barrier 70 comprises two barrier sections, it will be understood that the number of barrier sections may vary. For example, in an alternative embodiment a third barrier section may be disposed in the chamber between the first and second barrier sections.

In the above described embodiments, the mesh panel of each barrier section is formed from a perforated sheet, it will be understood that the mesh panel may have an alternative arrangement. For example, the mesh panel of each barrier section may be formed from a wire mesh.

Although in the above described arrangements the entire foaming restriction barrier 70 is formed by mesh panel material, it will be understood that alternative arrangements are envisaged. For example, in one embodiment each of the first and second barrier sections 71, 72 has a frame (not shown) surrounding the mesh panel material to support the mesh panel material.

Although the steam generator 40 is described above for evaporating water into steam, it will be understood that the steam generator 40 may be used with alternative liquids.

The above embodiments as described are only illustrative, and not intended to limit the technique approaches of the present invention. Although the present invention is described in details referring to the preferable embodiments, those skilled in the art will understand that the technique approaches of the present invention can be modified or equally displaced without departing from the spirit and scope of the technique approaches of the present invention, which will also fall into the protective scope of the claims of the present invention. In the claims, the word "comprising" does not exclude other elements or steps, and the indefinite article "a" or "an" does not exclude a plurality. Any reference signs in the claims should not be construed as limiting the scope.

The invention claimed is:

1. A steam generator for a steaming device comprising:
a chamber having a base and a liquid receiving space above the base,
a heater for heating water in the liquid receiving space,
a steam outlet, and
a foaming restriction barrier disposed between the steam outlet and the base, comprising: a first barrier section spaced from the liquid receiving space between the steam outlet and the liquid receiving space, the first barrier section being configured to prevent foam from passing into said steam outlet; and a second barrier section spaced from the first barrier section between the first barrier section and the liquid receiving space, the second barrier section comprising a recessed portion defining a recess, which extends into the liquid receiving space, the second barrier section being configured to prevent foam from passing from said liquid receiving space into an intermediate space between said first and second barrier sections, wherein the second barrier section is configured so that all the steam generated from heating water in the liquid receiving space below the second barrier section passes through the second barrier section into the intermediate space and, from the intermediate space through the first barrier section, before passing through the steam outlet.

2. The steam generator according to claim 1, wherein the first barrier section covers the steam outlet.

3. The steam generator according to claim 1, wherein the first barrier section is substantially L-shaped.

4. The steam generator according to claim 1, wherein the steam outlet is disposed in a corner of the chamber, and the first barrier section covers said corner.

5. The steam generator according to claim 1, wherein the second barrier section covers the liquid receiving space.

6. The steam generator according to claim 1, wherein the recessed portion is an elongated dome shape.

7. The steam generator according to claim 1, further comprising a water probe to detect water in said liquid receiving space, wherein the water probe is in the recess.

8. The steam generator according to claim 1, further comprising a water inlet passing through said second barrier section and reaching the liquid receiving space.

9. The steam generator according to claim 1, wherein the foaming restriction barrier comprises a mesh panel.

10. A steaming device comprising a steam generator according to claim 1.

11. A steam generator for a steaming device comprising:
a chamber having a base and a liquid receiving space above the base;
a heater for heating water in the liquid receiving space;
a steam outlet;
a foaming restriction barrier disposed between the steam outlet and the base, comprising:
a first barrier section spaced from the liquid receiving space between the steam outlet and the liquid receiving space, the first barrier section being configured to prevent foam from passing into said steam outlet; and a second barrier section spaced from the first barrier section between the first barrier section and the liquid receiving space, wherein the first barrier section being configured to prevent foam from passing into said steam outlet, the second barrier section being configured to prevent foam from passing from said liquid receiving space into an intermediate space between said first and second barrier sections, wherein the second barrier section is configured so that all the steam generated from heating water in the liquid receiving space below the second barrier section passes through the second barrier section into the intermediate space and, from the intermediate space through the first barrier section, before passing through the steam outlet; and
a water inlet passing through said second barrier section and reaching the liquid receiving space.

12. The steam generator according to claim 11, wherein the first barrier section covers the steam outlet.

13. The steam generator according to claim 11, wherein the first barrier section is substantially L-shaped.

14. The steam generator according to claim 11, wherein the steam outlet is disposed in a corner of the chamber, and the first barrier section covers said corner.

15. The steam generator according to claim 11, wherein the second barrier section covers the liquid receiving space.

16. The steam generator according to claim 11, further comprising a water inlet passing through said second barrier section and reaching the liquid receiving space.

17. The steam generator according to claim 11, wherein the foaming restriction barrier comprises a mesh panel.

18. A steaming device comprising a steam generator according to claim 11.

* * * * *